US006931225B2

(12) United States Patent
Yamashita

(10) Patent No.: US 6,931,225 B2
(45) Date of Patent: Aug. 16, 2005

(54) METHOD AND APPARATUS FOR CLEANING A CHARGING DEVICE

(75) Inventor: Toshimi Yamashita, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 120 days.

(21) Appl. No.: 10/679,363

(22) Filed: Oct. 7, 2003

(65) Prior Publication Data

US 2005/0074256 A1 Apr. 7, 2005

(51) Int. Cl.[7] ..... G03G 21/00
(52) U.S. Cl. ..... 399/100
(58) Field of Search ..... 399/99, 100, 173; 250/324–326

(56) References Cited

U.S. PATENT DOCUMENTS 6,381,432 B1 * 4/2002 Hattori ..... 399/100

FOREIGN PATENT DOCUMENTS

| | | | |
|---|---|---|---|
| JP | 9-211940 | A | 8/1997 |
| JP | 11-327265 | A | 11/1999 |
| JP | 2000-58224 | A | 2/2000 |

* cited by examiner

*Primary Examiner*—Susan Lee
(74) *Attorney, Agent, or Firm*—Foley & Lardner LLP

(57) ABSTRACT

An image forming device is provided with a photosensitive body which applies a toner on a media, an electrode which charges the photosensitive body to a prescribed potential, and a cleaning member which removes contaminants from the electrode using a polishing agent. The cleaning member includes an inner region having a first amount of the polishing agent, and an outer region radially outward from the inner region and having a second amount of the polishing agent, wherein the first amount is less than the second amount.

20 Claims, 2 Drawing Sheets

METHOD AND APPARATUS FOR CLEANING A CHARGING DEVICE

BACKGROUND OF THE INVENTION

A. Field of the Invention

The invention relates generally to image forming devices, and more particularly to a method and apparatus for removing contaminants from an electrode in an image forming device using a polishing agent.

B. Background of the Invention

Electrodes for charging a photosensitive body to a prescribed potential in image forming devices such as photocopiers, facsimile machines, and laser printers are known. Over time, these electrodes become contaminated with residual toner, dust, etc., and thus require regular cleaning. As such, cleaning members have been proposed for cleaning contaminated electrodes as part of image forming devices and the like that include such electrodes. However, a need still exists for low cost cleaning members and cleaning members that remove a greater amount of contaminates.

SUMMARY OF THE INVENTION

According to one embodiment of the present invention, an image forming device is provided with a photosensitive body which applies a toner on a media, an electrode which charges the photosensitive body to a prescribed potential, and a cleaning member which removes contaminants from the electrode using a polishing agent. The cleaning member preferably includes an inner region having a first amount of the polishing agent, and an outer region radially outward from the inner region and having a second amount of the polishing agent, wherein the first amount is less than the second amount.

According to another embodiment of the present invention, a method of cleaning an electrode in an image forming device is provided, the electrode including a plate having a sawtoothed-shaped tip. The method includes steps of moving a cleaning member substantially parallel to a plane of the plate, compressing the cleaning member with the sawtoothed-shaped tip, and removing contaminants from the sawtoothed-shaped tip using a polishing agent via contact between the cleaning member and the sawtoothed-shaped tip. Preferably, the cleaning member includes an inner region having a first amount of the polishing agent, and an outer region radially outward from the inner region and having a second amount of the polishing agent, wherein the first amount is less than the second amount.

According to another embodiment of the present invention, an image forming device is provided with means for applying a toner on a media, means for applying a prescribed charge on the means for applying a toner on a media, and means for cleaning the means for applying a prescribed charge. The means for cleaning preferably has a higher concentration of polishing agent in an outer region than in an inner region of the means for cleaning.

Further features, aspects and advantages of the present invention will become apparent from the detailed description of preferred embodiments that follows, when considered together with the accompanying drawing figures.

DETAILED DESCRIPTION OF EXEMPLARY EMBODIMENTS

Reference will now be made in detail to presently preferred embodiments of the invention. Wherever possible, the same reference numbers will be used throughout the drawings to refer to the same or like parts.

Figure 1:
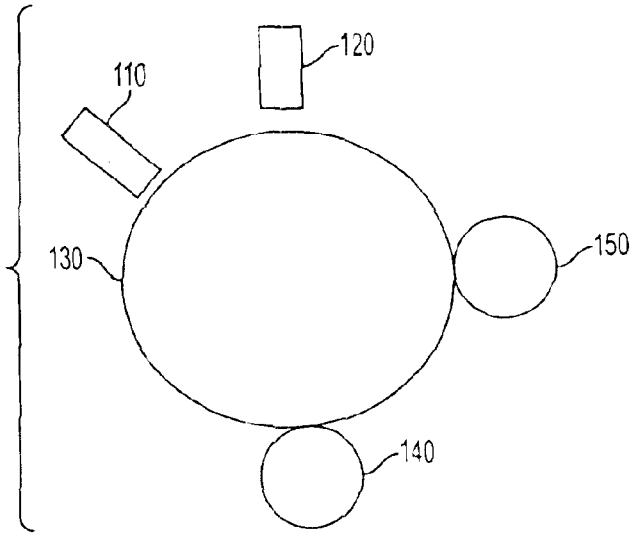
FIG. 1 is a block diagram of an image forming unit according to an embodiment of the present invention.

An image forming unit useable with various embodiments of the present invention is shown in the block diagram of FIG. 1. The image formation unit includes a photosensitive drum 130 (i.e., one type of photosensitive body) for applying a toner on a media, a charging device 120 for charging the photosensitive drum 130 to a prescribed potential, a developer roller 150 for applying the toner onto the photosensitive drum 130, a cleaning apparatus 110 for cleaning residual toner off of the photosensitive drum 130, and a transfer roller 140 for removing imaged media from the photosensitive drum 130. Other components are normally provided in the image forming unit, as known and would be readily apparent to one of ordinary skill in the art based on the present disclosure.

Figure 2:
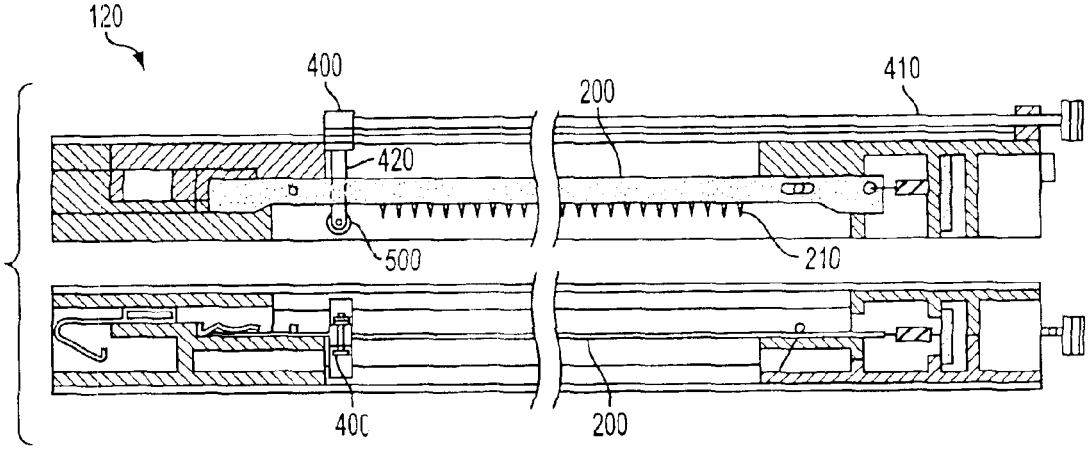
FIG. 2 is a block diagram of a charging device according to an embodiment of the present invention.

An exemplary charging device 120 according to another embodiment of the present invention is shown in greater detail in the block diagram of FIG. 2. Preferably, the charging device 120 includes an electrode plate 200 having a sawtoothed-shaped tip 210 as shown best in FIG. 3 and FIG. 4A. The sawtoothed-shaped tip 210 is used to charge the photosensitive drum 130 to a prescribed potential, the photosensitive drum 130 being shown in FIG. 1. As such, two or more electrode plates 200 may be used depending on the particular implementation, with two electrode plates 200 being shown in FIG. 2.

Figure 3:
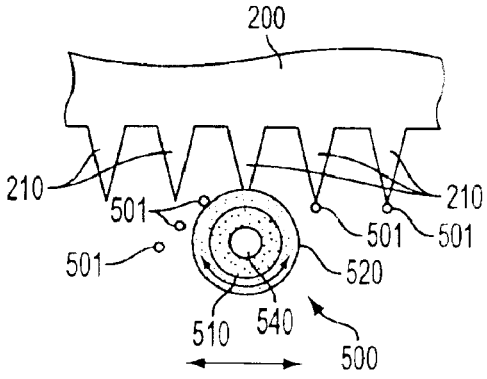
FIG. 3 is an enlarged view of an electrode plate and a cleaning member according to an embodiment of the present invention.
Figure 5:
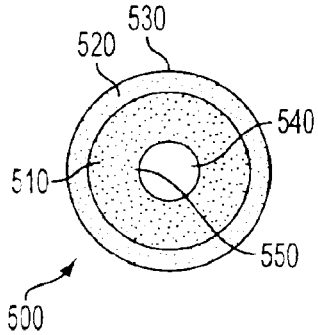
FIG. 5 is a side view of a cleaning member having distinct layers according to an embodiment of the present invention.

Additionally, as part of the charging device 120 or as a separate component, a cleaning member 500 (e.g., an elastic foam roller) is provided for removing contaminants 501 from the electrode plate 200 (see FIG. 3). As shown best in FIG. 5, the cleaning member 500 preferably includes an inner region 510 having a first amount of a polishing agent, and an outer region 520 radially outward from the inner region 510 and having a second amount of polishing agent. It should be appreciated that the outer region 520 may include outer surface 530 as shown, and/or inner region may include inner surface 550 as shown. Additionally, the inner region 510 and outer region 520 may each comprise a distinct layer as shown in FIG. 5, and may be included in a plurality of distinct layers greater than the two layers shown. Preferably, each of the two or more layers within the cleaning member 500 has a different amount of the polishing agent.

Figure 4A:
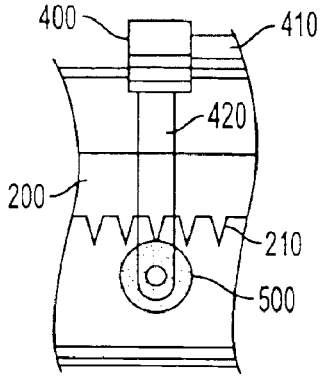
FIG. 4A is a side view of a cleaning mechanism according to an embodiment of the present invention.
Figure 4B:
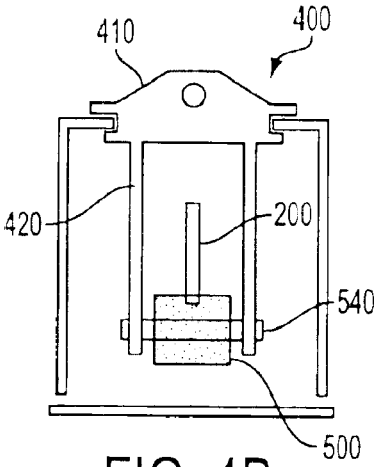
FIG. 4B is a front view of the cleaning mechanism of FIG. 4A.

As shown in the side view of FIG. 4A and front view of FIG. 5B, the cleaning member 500 may form part of a cleaning mechanism 400. Cleaning mechanism 400 preferably includes a slide mechanism 410 configured to move cleaning member 500 substantially parallel to a plane of the electrode plate 200 as indicated by the arrows shown in FIG. 3. In this regard, cleaning member 500 may be positioned at a fixed distance from slide mechanism 410 via legs 420 with through pin 540. As such, legs 420 are preferably configured to have a length set so as to cause cleaning member 500 to contact the sawtoothed-shaped tips 210 of electrode plate 200 as cleaning member 500 is moved across the electrode plate 200. More preferably, the legs 420 have a length set such that the sawtoothed-shaped tips 210 cause a slight compression of cleaning member 500, thereby "rubbing off" contaminates 501 from sawtoothed-shaped tips 210 due to contact between cleaning member 500 and the sawtoothed-shaped tips 210.

To further improve the cleaning performance of the cleaning member 500, a polishing agent is provided, such as a resin including one or more of silicon carbide, silicon nitride, cerium oxide, iron oxide, chromium oxide, and alumina particles. Preferable, the polishing agent particles have an average particle diameter in the range of about 0.01 to about 2 microns, more preferably in the range of about 0.01 to about 1 microns.

Figure 6:
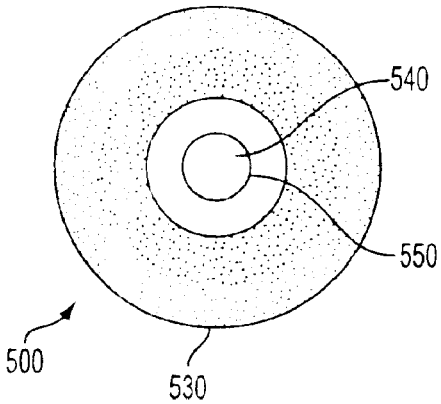
FIG. 6 is a side view of a cleaning member having a gradually changing amount of a polishing agent according to another embodiment of the present invention.

Additionally, the amount of polishing agent in the inner region 510 and the outer region 520 is different, such that the inner region 510 has a smaller amount of polishing agent than the outer region 520. By way of example, the inner region 510 may have little or substantially no polishing agent, and the outer region 510 may have an amount of polishing agent ranging from about 0.01% to about 5% by weight. Furthermore, the amount of polishing agent in inner region 510 and/or outer region 520 may be substantially uniform throughout a given layer as shown in FIG. 5, or may gradually change in one or both of inner region 510 and/or outer region 520 as shown in FIG. 6, so long as the inner region 510 has less polishing agent than the outer region 520.

A table comparing conventional cleaning techniques to various embodiments of the present invention using a polishing agent in cleaning member 500 is provided below for illustration purposes. In particular, the following table is provided in reference to a cleaning technique described in Japanese Reference 9-211940 to Nakakama, which is incorporated by reference herein in its entirety.

| Current Applied To The Electrode ($\mu$A) | Before Cleaning | Conventional Cleaning | Cleaning Of Present Invention |
|---|---|---|---|
| 900 | X | ○ | ○ |
| 800 | X | ○ | ○ |
| 700 | X | ○ | ○ |
| 600 | X | Z | ○ |
| 500 | X | X | ○ |
| 400 | X | X | ○ |
| 300 | X | X | ○ |

X: Unevenness appears on a white media (white media being the media on which an image is formed).
Z: Unevenness appears in have-tone mode on a white media.
○: Substantially no unevenness appears on a white media.

As can be seen from the table provided above, the cleaning member 500 according to various embodiments of the present invention provides a greater degree of cleaning over conventional cleaning techniques using the same charging device 120, particularly with amperages of 600 $\mu$A or less being used for the charging device 120 (the current being applied during an image forming process). Hence, the present invention reduces the appearance of uneven images, reduces contaminate related damaging of electrode plate 200, and other problems associated with inadequate cleaning of the charging device 120. Other advantages will also be realized by practicing various embodiments of the present invention, as would be readily apparent to one of ordinary skill in the art after reading this disclosure.

The foregoing description of preferred embodiments of the invention has been presented for purposes of illustration and description. It is not intended to be exhaustive or to limit the invention to the precise form disclosed, and modifications and variations are possible in light in the above teachings or may be acquired from practice of the invention. The aspects of the embodiments may be combined with one another. The embodiments were chosen and described in order to explain the principles of the invention and a practical application to enable one skilled in the art to utilize the invention in various embodiments and with various modifications are suited to the particular use contemplated.

What is claimed is:

1. An image forming device, comprising:

a photosensitive body which applies a toner on a media;

an electrode which charges the photosensitive body to a prescribed potential; and a cleaning member which removes contaminants from the electrode using a polishing agent, the cleaning member including:

an inner region having a first amount of the polishing agent; and an outer region radially outward from the inner region and having a second amount of the polishing agent, wherein the first amount is less than the second amount.

2. The image forming device of claim 1, wherein a concentration of the polishing agent in the cleaning member gradually increases from the inner region to the outer region.

3. The image forming device of claim 1, wherein the inner region and the outer region each comprise a distinct layer, and wherein the cleaning member includes more than two distinct layers, each layer having a different amount of the polishing agent.

4. The image forming device of claim 1, wherein the first amount is substantially zero.

5. The image forming device of claim 1, wherein the second amount is in the range of about 0.01% to about 5% by weight.

6. The image forming device of claim 1, wherein the polishing agent comprises polishing particles having a diameter in the range of about 0.01 to about 2 microns.

7. The image forming device of claim 6, wherein the polishing agent comprises polishing particles having a diameter in the range of about 0.01 to about 1 microns.

8. The image forming device of claim 1, wherein the cleaning member comprises an elastic foam including the polishing agent.

9. The image forming device of claim 1, wherein the electrode includes a plate having a sawtoothed-shape tip.

10. The image forming device of claim 9, wherein the cleaning member is configured to move substantially parallel to a plane of the plate and to contact the sawtoothed-shaped tip.

11. The image forming device of claim 10, wherein the sawtoothed-shaped tip contacts the inner region of the cleaning member as the cleaning member is moved substantially parallel to the plane of the plate.

12. A method of cleaning an electrode in an image forming device, the electrode including a plate having a sawtoothed-shaped tip, the method comprising:

moving a cleaning member substantially parallel to a plane of the plate;

compressing the cleaning member with the sawtoothed-shaped tip; and removing contaminants from the sawtoothed-shaped tip using a polishing agent via contact between the cleaning member and the sawtoothed-shaped tip, wherein the cleaning member includes an inner region having a first amount of the polishing agent; and an outer region radially outward from the inner region and having a second amount of the polishing agent, wherein the first amount is less than the second amount.

13. The method of claim 12, wherein a concentration of the polishing agent in the cleaning member gradually increases from the inner region to the outer region.

14. The method of claim 12, wherein the inner region and the outer region each comprise a distinct layer, and wherein the cleaning member includes more than two distinct layers, each layer having a different amount of the polishing agent.

15. The method of claim 12, wherein the first amount is substantially zero.

16. The method of claim 12, wherein the second amount is in the range of about 0.01% to about 5% by weight.

17. The method of claim 12, wherein the polishing agent comprises polishing particles having a diameter in the range of about 0.01 to about 2 microns.

18. The method of claim 17, wherein the polishing agent comprises polishing particles having a diameter in the range of about 0.01 to about 1 microns.

19. The method of claim 12, wherein the cleaning member comprises an elastic foam including the polishing agent.

20. An image forming device, comprising:

means for applying a toner on a media;

means for applying a prescribed charge on the means for applying a toner on a media; and means for cleaning the means for applying a prescribed charge, the means for cleaning having a higher concentration of polishing agent in an outer region than in an inner region of the means for cleaning.

* * * * *